US008734614B2

(12) United States Patent
Takano et al.

(10) Patent No.: US 8,734,614 B2
(45) Date of Patent: May 27, 2014

(54) POLYPHENYLENE SULFIDE FIBER, METHOD FOR PRODUCING THE SAME, WET-LAID NONWOVEN FABRIC, AND METHOD FOR PRODUCING WET-LAID NONWOVEN FABRIC

(75) Inventors: Tomoko Takano, Otsu (JP); Koji Sugano, Otsu (JP); Yuhei Maeda, Mishima (JP); Takeshi Sugimoto, Ehime (JP)

(73) Assignee: Toray Industries, Inc. (JP)

( * ) Notice: Subject to any disclaimer, the term of this patent is extended or adjusted under 35 U.S.C. 154(b) by 177 days.

(21) Appl. No.: 13/002,700

(22) PCT Filed: Jul. 8, 2009

(86) PCT No.: PCT/JP2009/062406

§ 371 (c)(1),
(2), (4) Date: Jan. 5, 2011

(87) PCT Pub. No.: WO2010/007919

PCT Pub. Date: Jan. 21, 2010

(65) Prior Publication Data

US 2011/0114274 A1 May 19, 2011

(30) Foreign Application Priority Data

Jul. 18, 2008 (JP) ..... 2008-186903
Sep. 16, 2008 (JP) ..... 2008-236059
Sep. 16, 2008 (JP) ..... 2008-236060

(51) Int. Cl.

| | |
|---|---|
| ***D21H 13/20*** | (2006.01) |
| ***D01F 6/00*** | (2006.01) |
| ***D01D 5/00*** | (2006.01) |
| ***C08G 75/14*** | (2006.01) |

(52) U.S. Cl.
USPC ..... 162/146; 162/157.1; 162/206

(58) Field of Classification Search
USPC ..... 162/141, 146, 157.1–157.3, 204–206; 528/373; 264/211.12
See application file for complete search history.

(56) References Cited

U.S. PATENT DOCUMENTS

| | | | | |
|---|---|---|---|---|
| 5,690,873 | A * | 11/1997 | Harwood et al. | 264/103 |
| 2002/0132546 | A1* | 9/2002 | Yamanaka et al. | 442/400 |
| 2009/0253329 | A1* | 10/2009 | Shimizu et al. | 442/340 |
| 2010/0285315 | A1 | 11/2010 | Horiguchi et al. | |

FOREIGN PATENT DOCUMENTS

| | | | |
|---|---|---|---|
| JP | 61-289162 | | 12/1986 |
| JP | 3-104923 | | 5/1991 |
| JP | 7-189169 | | 7/1995 |
| JP | 2003-221731 | | 8/2003 |
| JP | 2004-285536 | | 10/2004 |
| JP | 2004-348984 | | 12/2004 |
| JP | 2007-39840 | | 2/2007 |
| JP | 2009030187 | A * | 2/2009 |
| JP | 2009133033 | A * | 6/2009 |
| WO | 2009/087901 | | 7/2009 |

OTHER PUBLICATIONS

Broughton et al, "Production and Evaluation of Meltblown Poly(phenylene sulfide)", [online], Auburn University, no date, [retrieved Sep. 22, 2012] Retrieved from the internet, <URL: http://www.eng.auburn.edu/users/royalb/MeltblownPPS.htm>.*

Machine translation of JP-2009030187 A, Advanced Industrial Property Network, Japan Patent Office, [online], [retrieved on Sep. 22, 2012]. Retrieved from the Internet: <URL: http://dossier1.ipdl.inpit.go.jp/AIPN/odse_top_dn.ipdl?N0000=7400 >.*

Machine translation of JP-2009133033 A, Advanced Industrial Property Network, Japan Patent Office, [online], [retrieved on Sep. 22, 2012]. Retrieved from the Internet: <URL: http://dossier1.ipdl.inpit.go.jp/AIPN/odse_top_dn.ipdl?N0000=7400 >.*

Hay et al "The conformation of crystalline poly(phenylene sulfide)", Polymer, 42 (2001), pp. 8297-8301.*

GenChem Textbook "State Functions", Chemical Education group, University of Wisconsin [online], no date [retrieved on Feb. 14, 2013]. Retrieved from the Internet, <URL: http://chemed.chem.wisc.edu/chempaths/GenChem-Textbook/State-Functions-822.html>.*

Thomas, L. "Use of multiple heating rate DSC and modulated temperature DSC to detect and analyze temperature-time-dependent transitions in metals", Technical Note, TA Instruments Applications Library [online], 2001 Retrieved from the Internet, <URL: http://www.tainstruments.com/main.aspx?id=46&n=2&siteid=11>.*

* cited by examiner

*Primary Examiner* — Dennis Cordray
(74) *Attorney, Agent, or Firm* — DLA Piper LLP (US)

(57) ABSTRACT

A polyphenylene sulfide fiber has an amount of heat of crystallization measured by DSC is 10 J/g or more and the degree of shrinkage on dry heating of 150° C.×30 minutes is 20% or less. A method produces a densified wet-laid nonwoven fabric by subjecting paper produced in a papermaking process and containing 60 to 100% by mass of a polyphenylene sulfide fiber having an amount of heat of crystallization of 10 J/g or more and an amount of heat of crystallization of the wet-laid nonwoven fabric before heating-pressurizing treatments is 5 J/g or more to heating-pressurizing treatment at a temperature that is not lower than the glass transition temperature and not higher than the melting point of the polyphenylene sulfide fiber.

17 Claims, No Drawings

POLYPHENYLENE SULFIDE FIBER, METHOD FOR PRODUCING THE SAME, WET-LAID NONWOVEN FABRIC, AND METHOD FOR PRODUCING WET-LAID NONWOVEN FABRIC

RELATED APPLICATIONS

This is a §371 of International Application No. PCT/JP2009/062406, with an international filing date of Jul. 8, 2009 (WO 2010/007919 A1, published Jan. 21, 2010), which is based on Japanese Patent Application Nos. 2008-186903, filed Jul. 18, 2008; 2008-236059, filed Sep. 16, 2008; and 2008-236060 filed Sep. 16, 2008, the subject matter of which is incorporated by reference.

TECHNICAL FIELD

This disclosure relates to a polyphenylene sulfide (this may, hereinafter, be referred to as "PPS") fiber, and particularly to a PPS fiber that is amorphous but low in degree of shrinkage and is best suited for papermaking or the like because it is easy to change shape due to heat. Moreover, the disclosure relates to a wet-laid nonwoven fabric containing the PPS fiber. Moreover, the disclosure relates to a densified wet-laid nonwoven fabric that contains a PPS fiber and is large in dielectric breakdown strength and a method for producing the same.

BACKGROUND

PPS fibers, which are superior in heat resistance and chemical resistance, are used for various applications, one of which is nonwoven fabric. Specifically, a wet-laid nonwoven fabric and a so-called electrically insulating paper each being composed of PPS fibers and containing amorphous PPS fibers (undrawn PPS fibers) as a binder are disclosed (JP 7-189169 A, JP 2004-285536 A). A wet-laid nonwoven fabric is obtained by mixing amorphous PPS fibers at the time of paper making, drying, and then performing pressurized heat treatment to fuse fibers with the amorphous PPS fibers. However, amorphous PPS fibers are problematic in that they have a high degree of shrinkage on dry heating and are inferior in dimension stability, and therefore they shrink at a time of drying in a papermaking step, so that wrinkles, blisters, uneven drying, and the like are generated in wet-laid nonwoven fabrics and good wet-laid nonwoven fabrics are not obtained. PPS fibers which has a low degree of shrinkage on dry heating and superior in thermal dimension stability are disclosed (JP 3-104923 A, JP 2003-221731 A), but these were crystallized PPS fibers (drawn PPS fibers) and were hardly used as a binder. Electrically insulating paper to be used for a capacitor, a transformer, a cable, and the like is required to have high dielectric breakdown strength. However, high dielectric breakdown strength was not able to be achieved by the technologies disclosed in JP 7-189169 A and JP 2004-285536 A. That is, it is conceivable that mixing amorphous PPS fiber as much as possible and melting it to fill voids therewith are effective for achieving a high insulation, but there was a problem that because an amorphous PPS fiber was poor in thermal dimension stability, it was poor in papermaking property and therefore its incorporation ratio could not be increased.

It could therefore be helpful to provide a PPS fiber that is amorphous, low in degree of thermal shrinkage, and suitable for a binder for papermaking or the like, a method for producing the same, as well as a wet-laid nonwoven fabric containing the above-mentioned PPS fiber, and a method for producing a highly insulating wet-laid nonwoven fabric.

SUMMARY

We discovered a PPS fiber that is suitable for a binder to be used for papermaking or the like and that is good in dispersibility in water is large in the amount of heat of crystallization, in other words, has an amorphous portion and is low in degree of thermal shrinkage. Specifically, the fact that amorphous portions are softened during a drying step or a heating-pressurizing step of papermaking to fuse together and serve as a binder and they are small in degree of thermal shrinkage has made it possible to obtain good nonwoven fabrics, such as wet-laid nonwoven fabrics, that hardly generate wrinkles caused by thermal shrinkage.

Moreover, we discovered that dielectric breakdown of a wet-laid nonwoven fabric is triggered by partial discharge that occurs in voids between fibers, and that it is important for improving the dielectric breakdown strength to obtain a dense wet-laid nonwoven fabric with few air layers or through-holes through which an electric current passes.

We thus provide:

(1) a PPS fiber, wherein the amount of heat of crystallization measured by a differential scanning calorimeter (this may hereinafter be referred to as DSC) is 10 J/g or more and the degree of shrinkage on dry heating of 150° C.×30 minutes is 20% or less; and (2) a method for producing a wet-laid nonwoven fabric, the method comprising subjecting a wet-laid nonwoven fabric containing 60 to 100% by mass of a polyphenylene sulfide fiber having an amount of heat of crystallization of 10 J/g or more and an amount of heat of crystallization of a polyphenylene sulfide fiber before heating-pressurizing treatment of 5 J/g or more to heating-pressurizing treatment at a temperature that is not lower than the glass transition temperature and not higher than the melting point of the polyphenylene sulfide fiber.

It is thus possible to obtain a PPS fiber that has a large amount of heat of crystallization and a low degree of thermal shrinkage and that is suitable for a papermaking binder with good dispersibility in water. Moreover, it is possible to obtain a densified wet-laid nonwoven fabric that is dense and superior in dielectric breakdown strength with stability.

DETAILED DESCRIPTION

The PPS fiber is characterized in that the amount of heat of crystallization measured by a DSC is 10 J/g or more and the degree of shrinkage on dry heating of 150° C.×30 minutes is 20% or less. PPS is a polymer that contains a phenylene sulfide unit, such as a p-phenylene sulfide unit and a m-phenylene sulfide unit, as a repeating unit. PPS may be a homopolymer of one of these units or alternatively may be a copolymer having both units. Moreover, a copolymer with another aromatic sulfide is also available.

The mass average molecular weight of PPS is preferably from 40,000 to 60,000. Adjustment to 40,000 or more makes it possible to obtain kinetic properties which are good as a PPS fiber. Adjustment to 60,000 or less leads to the reduction in the viscosity of a solution of melt spinning and obviates the necessity of a spinning facility that is specially designed for withstanding high pressure.

It is necessary that the amount of heat of crystallization of the PPS fiber measured by DSC measurement is 10 J/g or more. When the amount of heat of crystallization is less than 10 J/g, there are amorphous portions, but the ratio of them relative to the whole fiber is so small that the amount of deformation due to heating and pressurizing becomes small, and therefore the PPS fiber no longer functions sufficiently as a binder. The amount of heat of crystallization at this time can be obtained by precisely weighing about 2 mg of a fiber sample after drying, and then measuring the amount of calorific value of a main exothermic peak observed during a first temperature elevation (first run) when the temperature is raised in nitrogen at a heating rate of 10° C./minute by using a differential scanning calorimeter (e.g., DSC-60 manufactured by Shimadzu Corporation). The amount of heat of crystallization is preferably 20 J/g or more, and the upper limit of the amount of heat of crystallization, which is not particularly limited because it does not become equal to or more than the amount of heat of crystallization of a completely amorphous state, is preferably 40 J/g or less.

The method of measuring the degree of shrinkage on dry heating is carried out in accordance with JIS L 1013:1999 8.18.2. Skein Shrinkage (Method A). A sample was wound at a rate of 120 times/minutes by the use of a sizing reel with a frame circumference of 1.125 m so that a small hank with a winding number of 20 was formed, and then a hank length was measured under a load of 0.088 cN/dtex. Next, the load is removed, and the small hank is hung in a dryer of 150° C. and is left at rest for 30 minutes by a method by which shrinkage is not prevented. Then, it is taken out and allowed to cool to room temperature. Then, a hank length is measured again under a load of 0.088 cN/dtex. A degree of shrinkage (%) on dry heating is measured using the following formula, and an average of five measurements can be calculated.

$$Sd=[(L-L1)/L]\times 100$$

Here, Sd: a degree of shrinkage (%) on dry heating

L: Length (mm) before drying

L1: Length (mm) after drying

The shrinkage on dry heating is preferably 15% or less, and more preferably 12% or less.

One example of the polymerization of a PPS resin to be preferably used is, but is not limited to, the following one. An autoclave with a stirrer is charged with 25 mol of sodium sulfide nonahydrate, 2.5 mol of sodium acetate, and N-methyl-2-pyrrolidone (henceforth, abbreviated as "NMP"), and the temperature is raised slowly to 205° C. while nitrogen is made to pass, so that water is distilled off. Next, the reaction vessel is cooled to 180° C., followed by the addition of 25.3 mol of 1,4-dichlorobenzene and NMP. Then, the vessel is closed hermetically under nitrogen and the temperature is raised to 270° C., followed by the execution of a reaction at 270° C. for 2.5 hours. Following the cooling, the reaction product is washed with warm water five times and then poured into NMP heated to 100° C., followed by continuing stirring for about one hour, filtration, and washing with boiling water several times. The residue is added to 25 liters of a pH 4 aqueous acetic acid solution heated to 90° C., followed by continuing stirring for about one hour, filtration, and washing with ion exchange water of about 90° C. until the pH of the filtrate becomes 7. Then, a PPS resin is obtained by performing drying under reduced pressure at 80° C. for 24 hours.

The PPS fiber can be obtained by heat treating, at a temperature that is equal to or lower than the crystallization temperature of PPS, a PPS fiber that has been spun at a spinning rate of 500 m/minute to 3000 m/minute using a PPS resin obtained in a manner as mentioned above, without performing drawing or heat fixation. If the spinning rate is less than 500 m/minute, the strength of a fiber becomes remarkably low and therefore post processing workability and product stability become poor. If the spinning rate exceeds 3000 m/minute, orientation increases, so that the degree of shrinkage will become very large as much as about 70%, the effect of heat treatment hardly becomes apparent and it becomes difficult to obtain a degree of shrinkage that is intended. A preferable range of the spinning rate is 500 m/minute or more and 2000 m/minute or less.

Regarding the temperature adjusted when spinning a thermoplastic polymer, it is preferable to perform spinning at a temperature of from (melting point +20° C.) to (melting temperature +50° C.) as in the production of general drawn yarn. At this time, the measurement of a melting point can be obtained, for example, by precisely weighing about 2 mg of a polymer sample after drying, and then determining, as a melting point, the value of a main endothermic peak observed by raising the temperature in nitrogen at a heating rate of 10° C./minute by using a differential scanning calorimeter (e.g., DSC-60 manufactured by Shimadzu Corporation).

Regarding a spinning instrument, an extruder type spinning machine, a pressure melter type spinning, and so on are available.

Moreover, it is important to perform heat treatment at a temperature that is equal to or lower than the crystallization temperature of PPS without performing drawing or heat fixation. Although drawing is performed at or above a glass transition temperature and after that heat fixation is performed at a temperature that is equal to or higher than a crystallization temperature in a general method for producing a PPS fiber, this method allows crystallization to proceed and therefore it is impossible to produce, by this method, a PPS fiber with many remaining amorphous portions. Moreover, even if the heat fixation is omitted from such a general method for producing a PPS fiber, the effect of heat treatment is hardly exhibited because a degree of thermal shrinkage becomes large, and it becomes difficult to achieve the intended degree of shrinkage. More preferably, the heat treatment temperature is (crystallization temperature −50° C.)≤(heat treatment temperature)≤(crystallization temperature −10° C.), and even more preferably is 80° C.≤(heat treatment temperature)≤95° C.

The crystallization temperature can be obtained by precisely weighing about 2 mg of a fiber sample after drying, and then measuring the temperature of a main exothermic peak observed by raising the temperature in nitrogen at a heating rate of 10° C./minute by using a differential scanning calorimeter (e.g., DSC-60 manufactured by Shimadzu Corporation).

As the method of heat treatment can be used both dry heat treatment and wet heat treatment. Examples of the dry heat treatment include contact heat treatment using a hot roller or the like, and non-contact heat treatment by, for example, infrared ray irradiation or heat treatment by the use of a band dryer using hot air, a dryer, or the like. In the wet heat treatment can be used steam, a hot bath, and so on.

Regarding the heat treatment time, there is no problem if it is within such a range that the physical properties are not impaired, but to develop an effect of inhibiting crystallization it is preferably adjusted to a time as short as possible in cases of high temperatures. However, a preferable heat treatment time is 0.01 seconds or more and 1 hour or less because the degree of shrinkage reduction effect caused by heat treatment will not be developed if the heat treatment time is excessively short.

The state of the yarn to be subjected to the heat treatment may be a state of a continuous yarn like a tow or, alternatively, the heat treatment may be applied to a yarn in a state of cut fiber that has been cut beforehand. A treatment step may be executed in a continuous process like the aforementioned hot roller or a continuous dryer or, alternatively, may be executed in a batch system such that a fixed amount of yarn is charged into a dryer or the like. Because of the superiority in production efficiency, it is preferable to carry out the step in a continuous process.

It is important for the heat treatment to be carried out while giving substantially no tension to a PPS fiber. If heat treatment is carried out under application of tension, degree of thermal shrinkage during the heat treatment does not occur sufficiently and larger degree of thermal shrinkage is generated when a high temperature is achieved by drying or the like in a papermaking step, and therefore wrinkles, blister, and the like will be generated. To give substantially no tension means to put a fiber in a tension-free state on a net, a vat, or the like when heat treatment is performed by using a continuous dryer, a dryer, or the like and also means to adjust a tension not so great as to allow a fiber to loosen to fail to pass the step when making the fiber pass a hot roller, a hot water bath, or the like.

The PPS fiber, which is not particularly limited with respect to fineness, preferably has a single fiber fineness of 0.1 dtex or more and 20 dtex or less, and more preferably 1 dtex or more and 10 dtex or less.

The PPS fiber may be provided with various sectional shapes like normal fibers except for leaving many amorphous portions and, for example, a round section, a polygonal section, such as a triangle and a quadrangle, a C-shaped section, a hollow section, a flattened section, a cross-shaped section, a π-shaped section, a #-shaped section, and the like are available.

The PPS fiber can be used as a filament after being wound as it is in the form of continuous fiber or can be used in the form of a staple fiber, a short cut fiber, or the like after being cut. At this time, crimp may be imparted according to need.

The PPS fiber can be used suitably as a binder fiber for papermaking because it has an amount of heat of crystallization and is low in dry heat shrinkage. This is because it is possible to eliminate generation of wrinkles, peeling or the like due to shrinkage in a drying step of continuous papermaking with conventional fibers that have an amount of heat of crystallization and are high in shrinkage on dry heating and it becomes possible to perform continuous papermaking at a high mixing ratio, which has not been achieved.

The fiber for papermaking preferably has a fiber length of 0.1 mm or more and 20 mm or less. By adjusting the fiber length to 0.1 mm or more, improvement in paper strength due to intertwinement of fibers can be expected, whereas by adjusting the fiber length to 20 mm or less, it is possible to prevent unevenness in basis weight or the like from generating due to, for example, formation of a bundle intertwinement of fibers.

Moreover, the existence of crimp is not restricted as a fiber for papermaking Furthermore, it is also permissible to mix a fiber with crimp and a fiber with no crimp. This is because regarding the existence of crimp, both a fiber with crimp and a fiber without crimp have an advantage. A PPS fiber with crimp is suitable for obtaining a wet-laid nonwoven fabric superior in strength with improved intertwineability with fibers. On the other hand, a PPS fiber without crimp is suitable for obtaining a uniform wet-laid nonwoven fabric with reduced unevenness. Therefore, whether crimp is to be given to a PPS fiber or not may be decided depending upon an application.

A preferable incorporation ratio in a wet-laid nonwoven fabric is not less than 40% by mass and up to 100% by mass. If the incorporation ratio is less than 40% by mass, the ratio of the PPS fiber as a binder is excessively small, leading to a reduction in binding force, so that a sufficient paper strength cannot be obtained.

By using the PPS fiber as a binder, it is possible to stably obtain a satisfactory wet-laid nonwoven fabric that hardly produces wrinkles or blister in a drying step or the like of papermaking because the amount of heat of crystallization is large, in other words, many amorphous portions remain and sufficiently functions as a binder, and also because the shrinkage on dry heating is so small that the thermal dimension stability is good.

The wet-laid nonwoven fabric may contain 10% by mass or more and 60% by mass or less of a fiber other than our PPS fiber. Although any fiber can be used as the other fiber, a heat-resistant fiber is preferred and a heat-resistant fiber may refer to, for example, a drawn and crystallized PPS fiber, a para-type, meta-type, or para-meta copolymerized totally aromatic polyamide fiber, a polyimide fiber, a polyparaphenylene benzobisoxazole fiber (henceforth, PBO fiber), and the like.

Next, the method for producing a wet-laid nonwoven fabric is explained. First, a dispersion liquid for papermaking is prepared by dispersing the PPS fiber and a fiber other than the PPS fiber in water.

The total amount of the fibers relative to the dispersion liquid for papermaking is preferably 0.005 to 5% by mass. If the total amount is adjusted to less than 0.005% by mass, a large amount of water is needed in a papermaking step, resulting in poor production efficiency. On the other hand, if it is increased to more than 5% by mass, the dispersion state of the fibers will become poor, so that it will become impossible to obtain a uniform wet-laid nonwoven fabric.

Regarding a dispersion liquid, it is permissible that a dispersion liquid of the PPS fiber and a dispersion liquid of a fiber other than the PPS fiber are prepared separately and then both are mixed with a papermaking machine or it is also permissible to directly prepare a dispersion liquid containing both fibers. To prepare dispersion liquids containing respective fibers separately and then mix both the liquids is desirable in that a stirring time can be controlled separately for the respective fibers according to their fineness, cut length, and the like, whereas to prepare a dispersion liquid containing both fibers is desirable from the viewpoint of step simplification.

To improve dispersibility in water, a dispersing agent containing a cationic, anionic, or nonionic surfactant, an oil, a defoaming agent for inhibiting generation of foams, and the like may be added to the dispersion liquid for papermaking.

A dispersion liquid for papermaking can be processed into a wet-laid nonwoven fabric by subjecting it to papermaking in a manner described above by the use of a papermaker of a cylinder paper machine, Fourdrinier machine, a inclined net type, or the like or a hand-making papermaker and then drying the resultant with a Yankee dryer, a rotary dryer, a continuous dryer, or the like. The drying in a papermaking step refers to drying with the aforementioned Yankee dryer, rotary dryer, continuous dryer, or the like. A wet-laid nonwoven fabric obtained via a papermaking step is subjected to heating-pressurizing treatment to yield a densified wet-laid nonwoven fabric.

When the densified wet-laid nonwoven fabric is used for an insulating paper application or the like, a sufficient dielectric breakdown strength is required.

It is conceivable that the dielectric breakdown of a wet-laid nonwoven fabric is triggered by partial discharge that occurs in voids between fibers. Since the PPS fiber is deformed readily by heating-pressurizing treatment, it fills voids in the surface of the densified wet-laid nonwoven fabric to yield a dense product that is almost free from through-holes and that has substantially no air permeability so that it can improve the dielectric breakdown strength.

Therefore, it is important to make the incorporation ratio of the PPS fiber large to increase the dielectric breakdown strength, and the incorporation ratio is preferably 60% by mass or more and 95% by mass or less, and more preferably is 75% by mass or more and 90% by mass or less. If it is less than 60% by mass, the densification is insufficient and it is impossible to achieve a high dielectric breakdown strength.

Since the PPS fiber is small in degree of shrinkage on dry heating and therefore is superior in thermal dimension stability, it has become possible to achieve a high incorporation ratio of an amorphous PPS fiber, which was previously impossible to achieve because wrinkles, blister, and the like occur in a drying step or a wet-laid nonwoven fabric is cut due to insufficient drying.

To make dielectric breakdown strength high as described above, it is important that the PPS fiber is deformed by heating-pressurizing treatment to fill voids. Hence, it is important that a sufficient amount of amorphous PPS fiber is contained in a wet-laid nonwoven fabric before heating-pressurizing treatment and, specifically, the amount of heat of crystallization of a wet-laid nonwoven fabric after papermaking drying (before heating-pressurizing treatment) is preferably 5 J/g or more, more preferably is 10 J/g or more, and even more preferably 15 J/g or more. In it is less than 5 J/g, it is impossible to achieve densification sufficiently and impossible to make the dielectric breakdown strength high.

To adjust the amount of heat of crystallization of a wet-laid nonwoven fabric before heating-pressurizing treatment to 5 J/g or more, it is important not to allow a PPS fiber to completely crystallize in a papermaking step. This is because crystallized PPS is hardly deformed even if it is softened and therefore it is impossible to fill voids sufficiently even if, for example, a high temperature is applied. Specifically, to achieve this heat of crystallization, it is preferable to adjust the drying temperature in the papermaking step to (the crystallization temperature of the PPS +10° C.) or lower, and more preferably it is adjusted to lower than the crystallization temperature. In particular, since crystallization of amorphous PPS readily advances at the crystallization temperature to (the crystallization temperature +10° C.), it is preferable to make the time for passing the drying step short. The amount of heat of crystallization of a wet-laid nonwoven fabric can be adjusted by a drying temperature, a drying time, and the like. The drying temperature refers to the highest temperature of a treating temperature (ambient temperature) at the time of drying in the aforementioned papermaking step.

If drying treatment is carried out at a temperature that is higher than (the crystallization temperature of the PPS fiber +10° C.), the crystallization of the PPS fiber advances unfavorably and even if heating-pressurizing treatment is applied to a wet-laid nonwoven fabric prepared by papermaking and drying, the PPS fiber cannot be fill up the voids of the wet-laid nonwoven fabric and therefore it is impossible to achieve a high dielectric breakdown strength. The drying temperature is preferably 80° C. or more and more preferably is 95° C. or more because if the drying temperature is excessively low, it is impossible to evaporate water and it is impossible to dry a wet-laid nonwoven fabric.

By subjecting the wet-laid nonwoven fabric obtained in the manner described above to heating-pressurizing treatment at a temperature that is not lower than the glass transition temperature and not higher than the melting point of the PPS fiber, a densified wet-laid nonwoven fabric can be obtained.

As the means of the heating-pressurizing treatment can be adopted hot pressing using flat plate or the like, calendering, and the like. Especially, calendering, which is continuously processible, is preferred. As a roll for calendering can be used a metal-metal roll, a metal-paper roll, a metal-rubber roll, and the like.

The pressure of the heating-pressurizing treatment such as calendering is preferably 98 N/cm to 20 kN/cm. By adjusting the pressure to 98 N/cm or more, it is possible to fill up voids between fibers. On the other hand, by adjusting the pressure to 20 kN/cm or less, it is possible to prevent the rupture or the like of the wet-laid nonwoven fabric in the heating-pressurizing treatment step to perform the treatment with stability.

It is necessary that the temperature condition of the heating-pressurizing treatment should be adjusted to not lower than the glass transition temperature and not higher than the melting point of the PPS fiber. If lower than the glass transition temperature, since the PPS fiber does not soften, it is impossible to fill up voids with the PPS fiber even if performing heating-pressurizing treatment and therefore it is impossible to increase the dielectric breakdown strength. At a temperature that is higher than the melting point, since the PPS fiber is melted to adhere to a roll or the like, it is impossible to perform continuous processing with stability. The temperature condition of the heating-pressurizing treatment is more preferably not lower than the crystallization temperature and 270° C. or less, and even more preferably not lower than 140° C. or more and not higher than 250° C. or less. The temperature of the heating-pressurizing treatment referred to herein means the temperature of a surface of an instrument with which the heating-pressurizing treatment is performed, the surface being to be in contact with a wet-laid nonwoven fabric and, for example, in a case of a flat plate heat pressing instrument, it is a surface temperature of the surface of the flat plate for heat pressing, the surface being to be in contact with a wet-laid nonwoven fabric, and in a case of a calendering instrument, it is a surface temperature of a calendering roll. Regarding the heating, both the front side and the rear side which come into contact with a wet-laid nonwoven fabric may be heated or, alternatively, one side may be heated.

The glass transition temperature and the melting point refer to values measured under the same conditions as those in the measurement of the amount of heat of crystallization described in [Methods of measurement-evaluation] (3) in the following Examples. The glass transition temperature is defined by an intersection of the baseline before the glass transition starting temperature and the tangent at the glass transition inflection point, and the melting point is defined by the top temperature of the main endothermic peak.

The processing speed in a case where calender processing is adopted as the heating-pressurizing treatment is preferably 1 to 50 m/min and more preferably is 1 to 20 m/min. By adjusting it to 1 m/min or more, it is possible to obtain good working efficiency. On the other hand, by adjusting it to 30 m/min or less, it is possible to conduct heat also to fibers inside a wet-laid nonwoven fabric to obtain a practical effect of the thermal fusion of fibers.

The densified wet-laid nonwoven fabric obtained in the manner described above can be one that has substantially no air permeability and has superior dielectric breakdown strength, specifically a dielectric breakdown strength of 20 kV/mm or more, while leaving properties as nonwoven fabric (paper). Moreover, it is possible to obtain a densified wet-laid nonwoven fabric having a dielectric breakdown strength of 30 kV/mm or more, which becomes possible to be developed to applications of electrically insulating paper for motors, transformers and the like to be used at a high voltage.

Specifically, a densified wet-laid nonwoven fabric having a dielectric breakdown strength of 30 kV/mm or more contains the PPS fiber in an amount of 60 to 100% by mass and can be obtained by subjecting a wet-laid nonwoven fabric with an amount of heat of crystallization before heating-pressurizing treatment of 5 J/g or more resulting from drying at a drying temperature of a papermaking step that is not higher than (the crystallization temperature of the PPS fiber +10° C.) to heating-pressurizing treatment at a temperature that is not lower than the glass transition temperature of the PPS fiber and not higher than the melting point of the PPS fiber.

The "dielectric breakdown strength" refers to a value measured in accordance with JIS C 2111:2002 (method C in the case of an alternating current) described in [Methods of measurement-evaluation] (6) of the following Examples.

The basis weight of a wet-laid nonwoven fabric and an electrically insulating paper are chosen in dependence on the place of use. From the viewpoints of prevention of rupture or damage of paper, good productivity, maintenance of dielectric breakdown strength, superiority in handleability, and the like, one of 30 g/m$^2$ to 850 g/m$^2$ can be used, and one of 30 g/m$^2$ to 500 g/m$^2$ can be used preferably.

A wet-laid nonwoven fabric produced by subjecting a wet-laid nonwoven fabric that contains 60 to 100% by mass of a PPS fiber with an amount of heat of crystallization at a crystallization peak of 10 J/g or more and has an amount of heat of crystallization of a PPS fiber before heating-pressurizing treatment of 5 J/g or more to heating-pressurizing treatment at a temperature that is not lower than the glass transition temperature of the PPS and not higher than the melting point of the PPS is favorable because it can achieve a high dielectric breakdown strength.

PPS fibers with an amount of heat of crystallization at a crystallization peak of 10 J/g or more include a PPS fiber that is produced by melt-spinning a PPS polymer with an extruder type spinning machine or the like and has not been subjected to heat treatment by drawing or the like. A PPS fiber with an amount of heat of crystallization at a crystallization peak of 10 J/g or more refers to one with which a crystallization peak can be observed substantially in a measurement (first run) by raising the temperature at a first time at a heating rate of 10° C./minute by DSC. It is noted that the term "substantially" means that the amount of heat of crystallization at a crystallization peak is 10 J/g or more.

For achieving a high dielectric breakdown strength, it is important to increase the incorporation ratio of the PPS fiber with an amount of heat of crystallization at a crystallization peak of 10 J/g or more, and the incorporation ratio is preferably 60% by mass or more and 95% by mass or less, and more preferably is 75% by mass or more and 90% by mass or less. If it is less than 60% by mass, the densification is insufficient and it is impossible to achieve a high dielectric breakdown strength.

To make the dielectric breakdown strength high as above-mentioned, it is important that the PPS fiber with an amount of heat of crystallization at a crystallization peak of 10 J/g or more deforms due to the heating-pressurizing treatment to fill up voids. Therefore, it is important that a sufficient amount of a PPS fiber with an amount of heat of crystallization at a crystallization peak of 10 J/g or more is contained in the wet-laid nonwoven fabric before heating-pressurizing treatment and, specifically, the amount of heat of crystallization of a wet-laid nonwoven fabric after papermaking drying (before heating-pressurizing treatment) is preferably 5 J/g or more, more preferably is 10 J/g or more, and even more preferably 15 J/g or more. In it is less than 5 J/g, it is impossible to achieve densification sufficiently and impossible to make the dielectric breakdown strength high.

By subjecting the wet-laid nonwoven fabric obtained in the above-mentioned manner to heating-pressurizing treatment at a temperature that is not lower than the glass transition temperature and not higher than the melting point of the PPS fiber with an amount of heat of crystallization at a crystallization peak of 10 J/g or more, it is possible to obtain a densified wet-laid nonwoven fabric.

As the means of the heating-pressurizing treatment can be adopted hot pressing using a flat plate or the like, calendering, and the like. Especially, calendering, which is continuously processible, is preferred. As a roll for calendering can be used a metal-metal roll, a metal-paper roll, a metal-rubber roll, and the like.

The pressure of the heating-pressurizing treatment such as calendering is preferably 98 N/cm to 20 kN/cm. By adjusting the pressure to 98 N/cm or more, it is possible to fill up voids between fibers. On the other hand, by adjusting the pressure to 20 kN/cm or less, it is possible to prevent the rupture or the like of the wet-laid nonwoven fabric in the heating-pressurizing treatment step to perform the treatment with stability.

It is necessary that the temperature condition of the heating-pressurizing treatment should be adjusted to not lower than the glass transition temperature and not higher than the melting point of a PPS fiber having an amount of heat of crystallization at a crystallization peak of 10 J/g or more. If lower than the glass transition temperature, since the PPS fiber with an amount of heat of crystallization at a crystallization peak of 10 J/g or more does not soften, it is impossible to fill up voids with the PPS fiber with an amount of heat of crystallization at a crystallization peak of 10 J/g or more even if performing heating-pressurizing treatment and therefore it is impossible to increase the dielectric breakdown strength. At a temperature that is higher than the melting point, since the PPS fiber is melted to adhere to a roll or the like, it is impossible to perform continuous processing with stability. The temperature condition of the heating-pressurizing treatment is more preferably not lower than the crystallization temperature and not higher than 270° C., and even more preferably not lower than 140° C. and not higher than 250° C. The temperature of the heating-pressurizing treatment referred to herein means the temperature of a surface of an instrument with which the heating-pressurizing treatment is performed, the surface being to be in contact with a wet-laid nonwoven fabric and, for example, in a case of a flat plate heat pressing instrument, it is a surface temperature of the surface of the flat plate for heat pressing, the surface being to be in contact with a wet-laid nonwoven fabric, and in a case of a calendering instrument, it is a surface temperature of a calendering roll. Regarding the heating, both the front side and the rear side which come into contact with a wet-laid nonwoven fabric may be heated or, alternatively, one side may be heated.

The glass transition temperature and the melting point refer to values measured under the same conditions as those in the measurement of the amount of heat of crystallization described in [Methods of measurement-evaluation] (3) in the following Examples. The glass transition temperature is defined by an intersection of the baseline before the glass transition starting temperature and the tangent at the glass transition inflection point, and the melting point is defined by the top temperature of the main endothermic peak.

The processing speed in a case where calender processing is adopted as the heating-pressurizing treatment is preferably 1 to 50 m/min and more preferably is 1 to 20 m/min. By adjusting it to 1 m/min or more, it is possible to obtain good working efficiency. On the other hand, by adjusting it to 30 m/min or less, it is possible to conduct heat also to fibers inside a wet-laid nonwoven fabric to obtain a practical effect of the thermal fusion of fibers.

To make the PPS fiber in the wet-laid nonwoven fabric before heating-pressurizing treatment have an amount of heat of crystallization of 5 J/g or more, it is important not to allow the PPS fiber with an amount of heat of crystallization at a crystallization peak of 10 J/g or more to crystallize completely in a papermaking step. Specifically, to achieve this heat of crystallization, it is preferable to adjust the drying temperature in the papermaking step to (the crystallization temperature of the PPS with an amount of heat of crystallization at a crystallization peak of 10 J/g or more +10° C.) or lower, and more preferably it is adjusted to lower than the crystallization temperature.

If drying treatment is performed at a temperature that is higher than (the crystallization temperature of the PPS with an amount of heat of crystallization at a crystallization peak of 10 J/g or more +10° C.), the crystallization of the PPS fiber with an amount of heat of crystallization at a crystallization peak of 10 J/g or more advances unfavorably and even if heating-pressurizing treatment is applied to a wet-laid nonwoven fabric prepared by papermaking and drying, the PPS fiber with an amount of heat of crystallization at a crystallization peak of 10 J/g or more cannot fill up the voids of the wet-laid nonwoven fabric and therefore it is impossible to achieve a high dielectric breakdown strength. The drying temperature is preferably 80° C. or more and more preferably is 95° C. or more because if the drying temperature is excessively low, it is impossible to evaporate water and it is impossible to dry a wet-laid nonwoven fabric.

In the wet-laid nonwoven fabric, other fibers may be mixed for 0 to 40% by mass other than the PPS fiber with an amount of heat of crystallization at a crystallization peak of 10 J/g or more. Although any fiber can be used as the other fiber, a heat-resistant fiber is preferred and a heat-resistant fiber may refer, for example, to a drawn and crystallized PPS fiber, a para-type, meta-type, or para-meta copolymerized totally aromatic polyamide fiber, a polyimide fiber, a PBO fiber, and the like.

A densified wet-laid nonwoven fabric obtained in the manner described above has substantially no air permeability and has a dielectric breakdown strength of 30 kV/mm or more while leaving properties as nonwoven fabric (paper), and it becomes possible to be developed to applications of electrically insulating paper for motors, transformers and the like to be used at a high voltage.

EXAMPLES

Methods of Measurement/Evaluation (1) Viscosity

An apparent viscosity at a shear rate of 1000 $sec^{-1}$ was measured by using a Capirograph 1B manufactured by Toyo Seiki Seisaku-Sho, Ltd.

(2) Intrinsic Viscosity (IV)

An intrinsic viscosity was calculated from a value measured in orthochlorophenol at 25° C.

(3) Amount of Heat of Crystallization (J/g)

The analysis was performed by precisely weighing about 2 mg of a fiber sample or a wet-laid nonwoven fabric sample after drying in a papermaking step, and then measuring the amount of calorific value of an exothermic peak observed during a first temperature elevation (first run) when the temperature was raised in nitrogen from 30° C. to 290° C. at a heating rate of 10° C./minute by using a differential scanning calorimeter (DSC-60 manufactured by Shimadzu Corporation) (the amount of energy (J) calculated from a peak area is divided by the mass (g) of a sample charged; PPS is usually observed its exothermic peak near 120° C.).

(4) Rate of Thermal Dimensional Change (Degree of Shrinkage on Dry Heating)

Measurement was carried out in accordance with JIS L 1013:1999 8.18.2. Skein Shrinkage (Method A). A sample was wound at a rate of 120 times/min by using a sizing reel having a frame circumference of 1.125 m to form a small hank with a number of winding of 20, and then a hank length was measured under a load of 0.088 cN/dtex. Next, the load was removed, and the small hank was hung in a dryer of 150° C. and was left at rest for 30 minutes by a method by which shrinkage is not prevented. Then, it was taken out and allowed to cool to room temperature. Then, a hank length was measured again under a load of 0.088 cN/dtex. A degree of shrinkage (%) on dry heating was measured using the following formula, and an average of five measurements was calculated.

$$Sd=[(L-L1)/L]\times 100$$

Here, Sd: degree of shrinkage (%) on dry heating

L: Length (mm) before drying

L1: Length (mm) after drying.

(5) Hand Papermaking Test

An aqueous dispersion liquid with a fiber concentration of about 1% by mass was prepared so that a prescribed fiber might account for a prescribed mixing ratio, and then a wet-laid nonwoven fabric with a prescribed basis weight was obtained by using a hand-making papermaker (an angular sheeting machine with automatic couching, manufactured by Kumagai Riki Kogyo Co., Ltd.) and then couching treatment was performed. This nonwoven fabric was charged into a KRK rotary dryer (standard type) manufactured by Kumagai Riki Kogyo Co., Ltd. while being undried, followed by treatment at a treating time of about 2.5 min/cycle, and then wrinkling of the wet-laid nonwoven fabric (drying step passability) and paper strength after drying (paper strength) were checked. Regarding the drying step passability, wrinkling in drying was judged; a sample that had few shrunk wrinkles and could be subjected to continuous papermaking was judged as ○, a sample in which shrunk wrinkles or peeling generated and which was presumed to be unusable for continuous papermaking was judged as x, and a sample of an intermediate condition was judged as Δ. Regarding the paper strength, a sample in which fibers fused therebetween and which seemed to be able to be subjected to continuous papermaking was judged as ○, a sample which was low in paper strength and was presumed to be unusable for continuous papermaking was judged as x, and a sample of an intermediate condition was judged as Δ.

(6) Dielectric Breakdown Strength

Measurement was performed in accordance with JIS K 6911: 1995. Specimens of about 10 cm×about 10 cm were taken at five points of a sample, and each specimen was sandwiched between disc-shaped electrodes having a diameter of 25 mm and a mass of 250 g. Using the air as a test medium, an alternating current voltage at a frequency of 60 Hz was applied with elevation of voltage at 0.25 kV/sec, and a voltage applied when the insulation was broken was measured. A dielectric breakdown strength was calculated by dividing the obtained dielectric breakdown voltage by the thickness of a central part that had been measured beforehand.

(7) Basis Weight

According to JIS L 1906: 2000 (mass per unit area), three specimens (10 cm×10 cm) were taken at different points of a sample, the weight (g) of each specimen mass in a standard state was measured, and the average thereof was expressed by a mass ($g/m^2$) per $m^2$.

Example 1

For PPS resin polymerization, an autoclave with a stirrer was charged with 25 mol of sodium sulfide nonahydrate, 2.5 mol of sodium acetate, and N-methyl-2-pyrrolidone (henceforth, abbreviated as NMP), and the temperature was raised slowly to 205° C. while nitrogen was made to pass, so that water was distilled off. Next, the reaction vessel was cooled to 180° C., followed by the addition of 25.3 mol of 1,4-dichlorobenzene and NMP. Then, the vessel was closed hermetically under nitrogen and the temperature was raised to 270° C., followed by the execution of a reaction at 270° C. for 2.5 hours. Following the cooling, the reaction product was washed with warm water five times and then poured into NMP heated to 100° C., followed by continuing stirring for about one hour, filtration, and washing with boiling water several times. The residue was added to 25 liters of a pH 4 aqueous acetic acid solution heated to 90° C., followed by continuing stirring for about one hour, filtration, and washing with ion exchange water of about 90° C. until the pH of the filtrate becomes 7. Then, a PPS resin was obtained by performing drying under reduced pressure at 80° C. for 24 hours.

This PPS resin was a resin having a melting point of 282° C. and a viscosity of 200 Pa·s at a temperature of 320° C. This polymer was spun at a temperature of 320° C. by using an existing single-component spinning machine. At this time, the discharge rate was adjusted to 35 g/minute and a spinneret with 120 discharge openings each being 0.13 phi-0.2 L was used. By conditioning a chimney to a temperature of 25° C. and a wind velocity of 25 m/minute, applying a common oil as a sizing agent, and hauling at a spinning rate of 1000 g/minute, an undrawn PPS yarn of 350.7 dtex-120 filaments was obtained. This undrawn yarn had a strength of 1.06 cN/dtex and a degree of elongation of 358%, and the crystallization temperature detected by DSC measurement was 130.7° C., the amount of heat was 32.9 J/g, and the degree of shrinkage on dry heating of 150° C.×30 minutes was 35.9%. This undrawn yarn was subjected to heating treatment for 15 minutes with hot water of 95° C. without performing drawing or heat fixation so that a desired fiber having an amount of heat of crystallization of 23 J/g and a degree of shrinkage on dry heating of 150° C.×30 minutes of 3.6% was obtained. This fiber was cut into 6 mm with a guillotine cutter, and no shrunk wrinkles were observed and the paper strength was satisfactorily high in a hand papermaking test (basis weight of 250 $g/m^2$) at 100% by weight. The drying temperature was adjusted to 110° C.

Examples 2 to 6, Comparative Examples 1 to 4

The undrawn yarn obtained in Example 1 was subjected to heat treatment at heat treating temperatures and heat treating times provided in Table 1 in a hot air dryer of 92° C. without performing drawing or heat fixation in Examples 2 to 6 and Comparative Examples 1 to 3, and then the amount of heat of crystallization and the rate of a dimensional change on heating (degree of shrinkage on dry heating) of fibers were measured. In Comparative Example 4, a certain amount of the undrawn yarn obtained in Example 1 was wound and fixed on a wooden frame of 30 cm on each side, and it was subjected to heat treatment with inhibition of degree of thermal shrinkage in a fixed length state. These fibers were cut into 6 mm with a guillotine cutter and subjected to a hand papermaking test at 100% by mass and a basis weight of about 250 $g/m^2$. Thus, their drying step passability and paper strength were evaluated. The drying temperature was adjusted to 110° C. The evaluation results are summarized in Table 1.

Example 1 to 6 were low in degree of shrinkage on dry heating, large in amount of heat of crystallization, and good in the result of the hand papermaking test. On the other hand, Comparative Examples 1, 2 and 4 were high in degree of shrinkage on dry heating and poor in drying step passability. In Comparative Example 3, the amount of heat of crystallization was small, almost no fusion between fibers occurred, the paper strength was low, and a paper strength that was high enough for performing continuous papermaking was not obtained.

TABLE 1

| | | Example 2 | Example 3 | Example 4 | Example 5 | Example 6 | Comparative Example 1 | Comparative Example 2 | Comparative Example 3 | Comparative Example 4 |
|---|---|---|---|---|---|---|---|---|---|---|
| Heat treatment temperature (° C.) | | 82 | 90 | 92 | 95 | 110 | None | 65 | 135 | 92 |
| Heat treatment time (min) | | 60 | 60 | 60 | 120 | 60 | None | 60 | 60 | 60 |
| Amount of heat of crystallization (J/g) | | 25 | 23 | 20 | 14 | 10 | 25 | 25 | 0 | 22 |
| Shrinkage (%) on dry heating | | 20 | 20 | 18 | 14 | 5 | 45 | 42 | 3 | 45 |
| Hand papermaking test | Drying step passability | Δ | ○ | ○ | ○ | ○ | x | x | ○ | x |
| | Paper strength | ○ | ○ | ○ | ○ | Δ | ○ | ○ | x | ○ |

Examples 7 to 14, Comparative Examples 4 to 7

Mixed paper (5) with an incorporation of a fiber in a total amount of 6.0 g such that the basis weight might become about 100 $g/m^2$ was produced in accordance with the procedure of "(5) Hand papermaking test" by using a formulation given in Table 2 containing the prescribed fiber material and a material produced by cutting the PPS fiber obtained in Example 4 with a guillotine cutter into 6 mm in Examples 7 to 14 and using a formulation given in Table 2 containing a product obtained by cutting the PPS undrawn PPS fiber obtained in Example 1 with a guillotine cutter into 6 mm and a prescribed fiber material in Comparative Examples 4 to 7, and the resulting mixed paper was dried at a drying temperature given in Table 2. The resulting wet-laid nonwoven fabric was subjected to heating-pressurizing treatment by calendering (temperature: 230° C., pressure: 0.5 t/cm, velocity: 2 m/min) by the use of an instrument with a steel roll (heating roll)/a paper roll (non-heating roll), and then the dielectric breakdown strength thereof was measured. The results are shown in Table 2. The details of each fiber material are as follows.

Drawn PPS fiber: manufactured by Toray Industries, Inc., "TORCON (registered trademark)," type S301 (the same as Example 3).

Totally aromatic polyamide fiber: manufactured by Du Pont-Toray Co., Ltd., "Kevlar (registered trademark)," pulp type 1F303.

Polyimide fiber: manufactured by Toyobo Co., Ltd., "P84 (registered trademark)," type J1.0T60-R060 (single fiber fineness 1 dtex) was cut into 6 mm with a guillotine cutter.

PBO fiber: manufactured by Toyobo Co., Ltd., "ZYLON (registered trademark)," Regular AS type (single fiber fineness 1.7 dtex) was cut into 6 mm with a guillotine cutter.

In Examples 7 to 14, the drying step passability in the hand papermaking test was good. Especially in each of Examples 7 to 10, the paper strength was high and a paper strength that was high enough for continuous papermaking was obtained successfully. Moreover, the amount of heat of crystallization of the wet-laid nonwoven fabric after drying was also large and a high dielectric breakdown strength was obtained successfully. In each of Examples 11 to 14, the paper strength was a little low, and an amount of heat of crystallization was not observed after drying and therefore the dielectric breakdown strength was low. In each of Comparative Examples 4 to 7, wrinkling, blister, or peeling generated in the drying step of a hand papermaking test and a good sample was not obtained, and therefore neither calendering treatment nor measurement of dielectric breakdown strength were able to be performed.

Examples 15 to 19

A mixed paper in which the PPS fiber obtained in Example 4 and having been cut into 6 mm with a guillotine cutter and the drawn PPS fiber used in Example 7 were mixed in a formulation given in Table 3 was produced according to the procedure of (5) hand papermaking test, and it was dried at a drying temperature and a number of treatments given in Table 3. The amount of heat of crystallization of the resulting wet-laid nonwoven fabric before calendering was measured. The resulting wet-laid nonwoven fabric was subjected to heating-pressurizing treatment by calendering (temperature: 230° C., pressure: 0.5 t/cm, velocity: 2 m/min) by the use of an instrument with a steel roll (heating roll)/a paper roll (non-heating roll), and then the dielectric breakdown strength thereof was measured. These results are shown in Table 3.

Regarding all levels, the results of the hand papermaking test (drying step passability and paper strength) were satisfactory without any problems. The wet-laid nonwoven fabrics varied in the amount of heat of crystallization with drying temperatures; the amount of heat of crystallization of the wet-laid nonwoven fabric was 0 J/g and the dielectric breakdown strength was also small in Example 17.

At a calendering temperature of 80° C. (Example 18), PPS fiber of Example 4 was softened insufficiently so that voids were not filled up, resulting in small dielectric breakdown strength. At a calendering temperature of 300° C. (Example 19), the wet-laid nonwoven fabric adhered to the calendering roll and therefore it was impossible to take a sample.

TABLE 2

| | | Example 7 | Example 8 | Example 9 | Example 10 | Example 11 | Example 12 | Example 13 | Example 14 | Comparative Example 4 | Comparative Example 5 | Comparative Example 6 | Comparative Example 7 |
|---|---|---|---|---|---|---|---|---|---|---|---|---|---|
| Ratio of PPS fiber of Example 4 (% by mass) | | 85 | 85 | 85 | 85 | 30 | 30 | 30 | 30 | | | | |
| Ratio of undrawn PPS fiber of Example 1 (% by mass) | | | | | | | | | | 85 | 85 | 85 | 85 |
| Ratio of drawn PPS fiber (% by mass) | | 15 | | | | 70 | | | | 15 | | | |
| Ratio of total aromatic polyamide fiber (% by mass) | | | 15 | | | | 70 | | | | 15 | | |
| Ratio of polyimide fiber (% by mass) | | | | 15 | | | | 70 | | | | 15 | |
| Ratio of PBO fiber (% by mass) | | | | | 15 | | | | 70 | | | | 15 |
| Papermaking drying temperature (° C.) | | 110 | 110 | 110 | 110 | 140 | 140 | 140 | 140 | 110 | 110 | 110 | 110 |
| Hand papermaking test | Drying step passability | ○ | ○ | ○ | ○ | x | x | x | x | x | x | x | x |
| | Paper strength | ○ | ○ | ○ | ○ | Δ | Δ | Δ | Δ | ○ | ○ | ○ | ○ |
| Amount of heat of crystallization (J/g) of wet-laid nonwoven fabric after drying | | 22 | 21 | 22 | 23 | 0 | 0 | 0 | 0 | 23 | 21 | 22 | 22 |
| Dielectric breakdown strength (kV/mm) | | 39 | 42 | 38 | 39 | 6 | 7 | 6 | 6 | — | — | — | — |

TABLE 3

| | | Example 15 | Example 16 | Example 17 | Example 18 | Example 19 |
|---|---|---|---|---|---|---|
| PPS fiber of Example 4 (g) | | 12 | 12 | 12 | 12 | 12 |
| Drawn PPS fiber (g) | | 3 | 3 | 3 | 3 | 3 |
| Papermaking drying temperature (° C.) | | 110 | 125 | 135 | 110 | 110 |
| Hand papermaking test | Drying step passability | ○ | ○ | ○ | ○ | ○ |
| | Paper strength | ○ | ○ | ○ | ○ | ○ |
| Number of drying treatments | | 4 | 4 | 4 | 4 | 4 |
| Amount of heat of crystallization (J/g) of wet-laid nonwoven fabric | | 20 | 12 | 0 | 20 | 20 |
| Heating-pressurizing treatment (calender) Temperature (° C.) | | 220 | 220 | 220 | 80 | 300 |
| Dielectric breakdown strength (kV/mm) | | 30 | 20 | 8 | 8 | — (*) |

(*) A sample was not able to be taken because it adhered to a calender roll.

Examples 20 to 24, Comparative Examples 8 to 12

In each of Examples 20 to 24 and Comparative Examples 8 to 12, an aqueous dispersion liquid with a fiber concentration of about 1% by mass was prepared by incorporating a prescribed fiber material provided in Table 4, and then a wet-laid nonwoven fabric with a prescribed basis weight was obtained by using a hand-making papermaker (an angular sheeting machine with automatic couching, manufactured by Kumagai Riki Kogyo Co., Ltd.) and then couching treatment was performed. This nonwoven fabric was charged into a KRK rotary dryer (standard type) manufactured by Kumagai Riki Kogyo Co., Ltd. while being undried, followed by drying at a treating time of about 2.5 min/cycle, and a drying temperature and a number of treatments given in Table 4. The resulting wet-laid nonwoven fabric was subjected to heating-pressurizing treatment by calendering (temperature: given in Table 4, pressure: 0.5 t/cm, velocity: 2 m/min) by the use of an instrument with a steel roll (heating roll)/a paper roll (non-heating roll), and then the dielectric breakdown strength thereof was measured. The results were shown in Table 4. The details of each fiber material are as follows.

(PPS Fiber (1-1): PPS Fiber with an Amount of Heat of Crystallization of 10 J/g or More)

"TORCON (registered trademark)" manufactured by Toray Industries, Inc., type S111 was used as PPS fiber (1-1) having a single fiber fineness of 3.0 dtex, a cut length of 6 mm, and a crimp number of 6 crimps/2.54 cm. The crystallization temperature determined by DSC was 120° C., and the amount of heat of crystallization was 24 J/g. The glass transition temperature was 90° C. and the melting point was 286° C.

(PPS Fiber (1-2): PPS Fiber with an Amount of Heat of Crystallization of 10 J/g or More)

"TORCON (registered trademark)" manufactured by Toray Industries, Inc., type S111 was used as PPS fiber (1-2) having been provided with no crimp (single fiber fineness 3.0 dtex, cut length 6 mm, with no crimp). The crystallization temperature determined by DSC was 120° C., and the amount of heat of crystallization was 24 J/g. The glass transition temperature was 90° C. and the melting point was 286° C.

(PPS Fiber (2-1), which is the Same as Drawn PPS Fiber of Example 7)

"TORCON (registered trademark)" manufactured by Toray Industries, Inc., type S101 was used as PPS fiber (2-1) having a single fiber fineness of 1.0 dtex, a cut length of 6 mm, and a crimp number of 13 crimps/2.54 cm. As a result of DSC measurement, no exothermic peak due to crystallization was observed.

(PPS Fiber (2-2): Crystallized PPS Fiber)

"TORCON (registered trademark)" manufactured by Toray Industries, Inc., type S101 was used as PPS fiber (2-2) having been provided with no crimp (single fiber fineness 1.0 dtex, cut length 6 mm, with no crimp). As a result of DSC measurement, no exothermic peak due to crystallization was observed.

As shown in Table 4, high dielectric breakdown strength was achieved successfully in Examples 20 to 24, but samples with high dielectric breakdown strength were not obtained in Comparative Examples 8 to 12.

TABLE 4

| | Example 20 | Example 21 | Example 22 | Example 23 | Example 24 | Comparative Example 8 | Comparative Example 9 | Comparative Example 10 | Comparative Example 11 | Comparative Example 12 |
|---|---|---|---|---|---|---|---|---|---|---|
| PPS fiber (1-1) (g) | 5.1 | 5.1 | 10.6 | 12.8 | — | 5.1 | 5.1 | 12.8 | 12.8 | 6.0 |
| PPS fiber (1-2) (g) | — | — | — | — | 5.1 | — | — | — | — | — |
| PPS fiber (2-1) (g) | 0.9 | 0.9 | 4.5 | 2.3 | — | 0.9 | 0.9 | 2.3 | 2.3 | 9.1 |
| PPS fiber (2-2) (g) | — | — | — | — | 0.9 | — | — | — | — | — |
| Treatment temperature (° C.) | 110 | 125 | 110 | 110 | 110 | 131 | 142 | 110 | 110 | 110 |
| Number of dry treatments (times) | 4 | 2 | 6 | 6 | 4 | 2 | 2 | 6 | 6 | 6 |

TABLE 4-continued

| | Example 20 | Example 21 | Example 22 | Example 23 | Example 24 | Comparative Example 8 | Comparative Example 9 | Comparative Example 10 | Comparative Example 11 | Comparative Example 12 |
|---|---|---|---|---|---|---|---|---|---|---|
| Amount of heat of crystallization (J/g) of wet-laid nonwoven fabric after drying | 20 | 15 | 16 | 20 | 20 | 2 | 0 | 20 | 20 | 8 |
| Heating-pressurizing treatment (calender) Temperature (° C.) | 220 | 220 | 220 | 220 | 220 | 220 | 220 | 80 | 300 | 220 |
| Mass per unit area (g/m2) | 90 | 90 | 235 | 235 | 90 | 95 | 95 | 235 | — (**) | 230 |
| Dielectric breakdown strength (kV/mm) | 40 | 26 | 24 | 45 | 38 | 12 | 11 | 9 | | 11 |

(**) A sample was not able to be taken because it adhered to a calender roll.

INDUSTRIAL APPLICABILITY

The PPS fiber is suitable for a binder of a nonwoven fabric, especially a wet-laid nonwoven fabric. The wet-laid nonwoven fabric can be used as toner wiping paper for copying machines or heat-resistant wet-laid nonwoven fabric such as a battery separator because of its superiority in heat resistance and chemical resistance, and in particular it can be used suitably for electrically insulating paper to be used for motors, capacitors, transformers, cables, and the like.

The invention claimed is:

1. A polyphenylene sulfide fiber having an amount of heat of crystallization determined by measuring an amount of calorific value of a main exothermic peak observed during a first temperature elevation (first run) when temperature is raised in nitrogen at a heating rate of 10° C./minute with a differential scanning calorimeter of 10 or more J/g and a degree of shrinkage on dry heating of 150° C. for 30 minutes of 20% or less, wherein the polyphenylene sulfide fiber is obtained by subjecting a polyphenylene sulfide fiber spun at a spinning rate of 500 m/min to 3000 m/min to heat treatment at a temperature that is equal to or lower than a crystallization temperature of the polyphenylene sulfide fiber before heat treatment determined by measuring the temperature of a main exothermic peak observed by raising the temperature in nitrogen at a heating rate of 10° C./minute using a differential scanning calorimeter, wherein the heat treatment is carried out without drawing the polyphenylene sulfide fiber or subjecting it to heat fixation.

2. A method of producing the polyphenylene sulfide fiber subjected to heat treatment according to claim 1, wherein the heat treatment temperature is within a range represented by the formula:

$$\text{crystallization temperature} - 50^\circ\text{ C.} \leq \text{heat treatment temperature} \leq \text{crystallization temperature} - 10^\circ\text{ C.},$$

wherein the crystallization temperature is determined by measuring the temperature of a main exothermic peak observed by raising the temperature in nitrogen at a heating rate of 10° C./minute using a differential scanning calorimeter.

3. The method according to claim 2, wherein the heat treatment temperature is within a temperature range of from 80° C. to 95° C.

4. The method according to claim 2, wherein the heat treatment is carried out without the application of tension.

5. The method according to claim 3, wherein the heat treatment is carried out without the application of tension.

6. A wet-laid nonwoven fabric containing 40 to 100% by mass of the polyphenylene sulfide fiber subjected to heat treatment according to claim 1.

7. The wet-laid nonwoven fabric according to claim 6, further comprising at least one member from the group consisting of other drawn polyphenylene sulfide fiber, a totally aromatic polyamide fiber, a polyimide fiber, and a polyparaphenylene benzobisoxazole fiber in an amount of not more than 60% by mass and not less than 10% by mass.

8. The wet-laid nonwoven fabric according to claim 6, wherein the amount of heat of crystallization of the wet-laid nonwoven fabric, determined by measuring an amount of calorific value of a main exothermic peak observed during a first temperature elevation (first run) when temperature is raised in nitrogen at a heating rate of 10° C./minute with a differential scanning calorimeter, is 5 J/g or more.

9. A method of producing the wet-laid nonwoven fabric according to claim 6, comprising heating-pressurizing treating paper produced in a papermaking process, wherein a papermaking drying temperature is no greater than 10° C. higher than the crystallization temperature determined by measuring the temperature of a main exothermic peak observed by raising the temperature in nitrogen at a heating rate of 10° C./minute by using a differential scanning calorimeter of the polyphenylene sulfide fiber obtained by subjecting a polyphenylene sulfide fiber spun at a spinning rate of 500 m/min to 3000 m/min to heat treatment at a temperature that is equal to or lower than a crystallization temperature of the polyphenylene sulfide fiber before heat treatment determined by measuring the temperature of a main exothermic peak observed by raising the temperature in nitrogen at a heating rate of 10° C./minute by using a differential scanning calorimeter, wherein the heat treatment is carried out without drawing the polyphenylene sulfide fiber or subjecting it to heat fixation.

10. A method of producing the wet-laid nonwoven fabric according to claim 6, comprising heating-pressurizing treating paper produced in a papermaking process, wherein the heating-pressurizing is carried out at a temperature not lower than the glass transition temperature and not higher than the melting point of a polyphenylene sulfide fiber obtained by subjecting a polyphenylene sulfide fiber spun at a spinning rate of 500 m/min to 3000 m/min to heat treatment at a temperature that is equal to or lower than a crystallization temperature of the polyphenylene sulfide fiber before heat treatment determined by measuring the temperature of a main exothermic peak observed by raising the temperature in nitrogen at a heating rate of 10° C./minute by using a differential scanning calorimeter, wherein the heat treatment is carried out without drawing the polyphenylene sulfide fiber or subjecting it to heat fixation.

11. A wet-laid nonwoven fabric produced by the method according to claim 10, wherein the dielectric breakdown strength is 30 kV/mm or more.

12. The wet-laid nonwoven fabric according to claim 7, wherein the amount of heat of crystallization of the wet-laid nonwoven fabric, determined by measuring an amount of calorific value of a main exothermic peak observed during a first temperature elevation (first run) when temperature is raised in nitrogen at a heating rate of 10° C./minute with a differential scanning calorimeter, is 5 J/g or more.

13. A method of producing the wet-laid nonwoven fabric according to claim 7, comprising drying paper produced in a papermaking process at a papermaking drying temperature no greater than 10° C. higher than the crystallization temperature determined by measuring the temperature of a main exothermic peak observed by raising the temperature in nitrogen at a heating rate of 10° C/minute by using a differential scanning calorimeter of a polyphenylene sulfide fiber obtained by subjecting a polyphenylene sulfide fiber spun at a spinning rate of 500 m/min to 3000 m/min to heat treatment at a temperature that is equal to or lower than a crystallization temperature of the polyphenylene sulfide fiber before heat treatment determined by measuring the temperature of a main exothermic peak observed by raising the temperature in nitrogen at a heating rate of 10° C./minute by using a differential scanning calorimeter, wherein the heat treatment is carried out without drawing the polyphenylene sulfide fiber or subjecting it to heat fixation.

14. A method of producing the wet-laid nonwoven fabric according to claim 7, comprising heating-pressurizing treating paper produced in a papermaking process, wherein the heating-pressurizing is carried out at a temperature not lower than the glass transition temperature and not higher than the melting point of a polyphenylene sulfide fiber obtained by subjecting a polyphenylene sulfide fiber spun at a spinning rate of 500 m/min to 3000 m/min to heat treatment at a temperature that is equal to or lower than a crystallization temperature of the polyphenylene sulfide fiber before heat treatment determined by measuring the temperature of a main exothermic peak observed by raising the temperature in nitrogen at a heating rate of 10° C./minute by using a differential scanning calorimeter, wherein the heat treatment is carried out without drawing the polyphenylene sulfide fiber or subjecting it to heat fixation.

15. A method of producing the wet-laid nonwoven fabric according to claim 8, comprising drying paper produced in a papermaking process at a papermaking drying temperature no greater than 10° C. higher than the crystallization temperature determined by measuring the temperature of a main exothermic peak observed by raising the temperature in nitrogen at a heating rate of 10° C/minute by using a differential scanning calorimeter of a polyphenylene sulfide fiber obtained by subjecting a polyphenylene sulfide fiber spun at a spinning rate of 500 m/min to 3000 m/min to heat treatment at a temperature that is equal to or lower than a crystallization temperature of the polyphenylene sulfide fiber before heat treatment determined by measuring the temperature of a main exothermic peak observed by raising the temperature in nitrogen at a heating rate of 10° C./minute by using a differential scanning calorimeter, wherein the heat treatment is carried out without drawing the polyphenylene sulfide fiber or subjecting it to heat fixation.

16. A method of producing a wet-laid nonwoven fabric comprising subjecting paper produced in a papermaking process and containing 60 to 100% by mass of a polyphenylene sulfide fiber having an amount of heat of crystallization determined by measuring an amount of calorific value of a main exothermic peak observed during a first temperature elevation (first run) when temperature is raised in nitrogen at a heating rate of 10° C./minute with a differential scanning calorimeter of 10 J/g or more to heating-pressurizing treatment at a temperature that is not lower than the glass transition temperature and not higher than the melting point of the polyphenylene sulfide fiber, wherein an amount of heat of crystallization of the wet-laid nonwoven fabric before heating-pressurizing treatment determined by measuring an amount of calorific value of a main exothermic peak observed during a first temperature elevation (first run) when temperature is raised in nitrogen at a heating rate of 10° C./minute with a differential scanning calorimeter is 5 J/g or more, and wherein the drying temperature of a papermaking step for producing the wet-laid nonwoven fabric is the crystallization temperature of the polyphenylene sulfide fiber having an amount of heat of crystallization of 10 J/g or more +10° C. or higher.

17. A wet-laid nonwoven fabric produced by the method according to claim 16, wherein the dielectric breakdown strength is 30 kV/mm or more.

* * * * *